US006783339B2

(12) United States Patent
Dong et al.

(10) Patent No.: US 6,783,339 B2
(45) Date of Patent: Aug. 31, 2004

(54) HYDRAULIC MOTOR WITH A SEPARATE SPOOL VALVE

(75) Inventors: Xingen Jeffrey Dong, Greeneville, TN (US); Brad P. Shupe, Greeneville, TN (US)

(73) Assignee: Parker Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/331,898

(22) Filed: Dec. 30, 2002

(65) Prior Publication Data

US 2003/0202896 A1 Oct. 30, 2003

Related U.S. Application Data

(60) Provisional application No. 60/375,618, filed on Apr. 24, 2002.

(51) Int. Cl.[7] ..... F03C 2/08

(52) U.S. Cl. ..... 418/61.3; 418/104; 418/142

(58) Field of Search ..... 418/61.3, 104, 418/142, 144

(56) References Cited

U.S. PATENT DOCUMENTS

| | | | | |
|---|---|---|---|---|
| 3,087,436 A | | 4/1963 | Dettlof et al. | 418/61.3 |
| 3,185,386 A | * | 5/1965 | Peras | 418/61.3 |
| 3,270,681 A | | 9/1966 | Charlson | 418/61.3 |
| 3,270,683 A | | 9/1966 | McDermott | 418/61.3 |
| 3,283,723 A | | 11/1966 | Charlson | 418/61.3 |
| 3,289,602 A | | 12/1966 | Hudgens | 418/61.3 |
| 3,473,437 A | | 10/1969 | Ohrberg | 418/61.3 |
| 3,514,234 A | | 5/1970 | Albers et al. | 418/61.3 |
| 3,547,563 A | | 12/1970 | Charlson | 418/61.3 |
| 3,547,564 A | * | 12/1970 | Charlson | 418/61.3 |
| 3,913,533 A | * | 10/1975 | Meaden | 418/61.3 |
| 4,253,807 A | | 3/1981 | Pahl | 418/61.3 |
| 4,545,748 A | * | 10/1985 | Middlekauff | 418/61.3 |
| 4,697,998 A | * | 10/1987 | Zumbusch | 418/61.3 |
| 5,080,567 A | * | 1/1992 | White, Jr. | 418/61.3 |
| 5,385,351 A | * | 1/1995 | White | 418/61.3 |

FOREIGN PATENT DOCUMENTS

| | | | |
|---|---|---|---|
| RU | 964196 | * 10/1982 | 418/142 |

OTHER PUBLICATIONS

Eaton Corporation, "Char–Lynn General Purpose Motors," Product Data Sheet, Jan. 1996, No. 1–162.
Danfoss Hydraulics, "Selection of Motor Type," Catalog.
Danfoss Hydraulics, "Hydraulic Motors, General," Catalog.
Danfoss Hydraulics, "Hydraulic Transmission Motor Type OMRW NF with Negative Brake and Needle Bearings," Catalog.
White, "RS Series," Catalog.

* cited by examiner

*Primary Examiner*—John J. Vrablik
(74) *Attorney, Agent, or Firm*—Renner, Otto, Boisselle & Sklar, LLP

(57) ABSTRACT

A hydraulic motor (10) comprising a front housing (12) which includes a first port (14) and a second port (16), a drive assembly (18), a drive link (22), and a shaft (24). The front housing (12) and the drive assembly (18) form a central bore (26) in which the drive link (22) and the shaft (24) are rotatably mounted. The drive assembly (18) comprises a spool valve (48) rotatably positioned within the central bore (26) and coupled to the shaft (24) by a key (140). Sealing rings (104) having a rotationally incompatible geometry (e.g., waved shapes) are used to seal interface surfaces of the rotor (54) and a high pressure seal assembly (156) is used to seal the front of a fluid chamber (154).

14 Claims, 7 Drawing Sheets

HYDRAULIC MOTOR WITH A SEPARATE SPOOL VALVE

RELATED APPLICATIONS

This application claims priority under 35 U.S.C. §119(e) to U.S. Provisional Application No. 60/375,618 filed Apr. 24, 2002. The entire disclosure of this earlier application is hereby incorporated by reference.

FIELD OF THE INVENTION

The present invention relates generally as indicated to a hydraulic motor and, more particularly, to a hydraulic motor with a gerotor drive assembly which provides rotational motion to a desired piece of machinery.

BACKGROUND OF THE INVENTION

A hydraulic motor is a converter of pressurized oil flow into torque and speed for transferring rotational motion to a desired piece of machinery. A hydraulic motor will have a flow circuit which determines the path of fluid flow and which includes a working path and a non-working path. The working path extends between its inlet port and its outlet port, and the fluid passes therethrough to cause the drive assembly to rotate the output shaft in the appropriate direction. The non-working path includes chambers surrounding the drive train components (e.g., the drive link and the output shaft), and fluid passes therethrough for cooling and lubrication of these components. In a two-pressure-zone motor design, fluid traveling through the non-working path rejoins fluid traveling through the working path somewhere upstream of the outlet port. In a three-pressure-zone motor design, fluid traveling through the non-working path does not rejoin the working path and exits the motor through a separate case drain in the housing.

Of particular relevance to the present invention is a hydraulic motor wherein the pressure-to-rotation conversion is accomplished by a drive assembly having a gerotor set. A gerotor set comprises an outer stator and an inner rotor having different centers with a fixed eccentricity. The stator has internal "teeth" or vanes which form circular arcs and the inner rotor has one less external "tooth" or lobe. The rotor lobes remain in contact with the circular arcs as the rotor moves relative to the stator and these continuous multi-location contacts create fluid pockets which sequentially expand and contract. As fluid is supplied and exhausted from the fluid pockets in a timed relationship, the rotor moves hypocycloidally (i.e., orbits and rotates) relative to the stator. A drive link is interconnected to the rotor for movement therewith, and this interconnection usually constitutes crowned external splines on the drive link which engage with internal splines on the rotor.

The drive link is interconnected to a shaft to transfer rotational movement thereto. For example, the motor can include a shaft, which is connected to the drive link (e.g., by a splined interconnection) and which can be coupled to the input shaft of the desired piece of machinery. Alternatively, the shaft can be part of the gearbox of the desired machinery and the drive link can be directly coupled thereto.

The drive assembly of a gerotor motor will typically include a valving system to supply and exhaust the fluid from the gerotor pockets in the desired timed relationship. One common type of valving system includes a spool valve which rotates with one of the drive train components (e.g., the output shaft or the drive link). A spool valve typically has a roughly cylindrical shape with inlets/outlets arranged about its outer circumferential surface so that it systematically opens and closes flow passages to and from the gerotor fluid pockets.

The spool valve can be located within the longitudinal bore of the motor's front housing member and surrounded by a stationary manifold. Typically, the spool valve is integrated with the output shaft (e.g., formed in one piece therewith or tightly attached thereto) and rotates therewith during operation of the motor. Motors of this design are not expected to take on large side loads and/or high radial torque due to the potential for spool damage in the event of shaft deflection.

The spool valve can instead be located to the rear of the longitudinal bore and rotated with the drive link during operation of the motor. Specifically, for example, the spool valve can be positioned in a rear housing member (having manifold-like channels) positioned between the front housing member and the motor's end cover. This design may minimize shaft-deflection issues, but it requires a substantial increase in the axial length, and thus package size, of the motor. While motor dimensions may not matter in some situations, they are crucial in many heavy duty applications.

Some of the most significant considerations when selecting a fluid motor, especially for heavy-duty applications, include the no-load pressure drop (or mechanical efficiency), life expectancy (e.g., service life), low speed performance, continuous operation condition, torque capacity, and side load limits. Accordingly, motor manufacturers are constantly trying to improve upon these performance parameters. Also, many heavy-duty motor applications are in environments with tight spacing tolerances, whereby package size (e.g., motor dimensions) can be as important as performance parameters. Furthermore, cost is almost always a concern, whereby economic considerations will usually always play a role in the development of a motor design.

SUMMARY OF THE INVENTION

The present invention provides a hydraulic motor comprising a front housing having a first port and a second port, a manifold, a spool valve, a drive link, and a shaft. The front housing and the manifold form a central bore in which the spool valve, the drive link and the shaft are rotatably mounted. The drive link transfers rotational motion to the shaft and the shaft is coupled to the spool valve so that rotational motion is transferred thereto. The coupling between the spool valve and the shaft includes a floating coupling element to prevent side loads on the shaft from being transferred to the spool valve. In this manner, the motor can take on large side loads and/or high radial torque while still positioning the spool valve in the front housing. This translates into a shorter package size and less working pressure drop.

The present invention also provides a sealing arrangement for rotating interfaces (e.g., the rotor and the end cover and/or a stationary component of the drive assembly), wherein the seal and the groove have a rotationally incompatible geometry. For example, the geometry can include a series of curved undulations, a series of corners, tabs, and/or notches which serve as rotation-preventing stops. The elimination of ring-rotation helps reduce interface friction, which can be especially significant during motor start-up as well as during continuous low speed operation of the motor, to thereby provide improved mechanical and hydraulic performance. Also, the minimization of interface friction in combination with the essential elimination of groove-to-seal friction (which results when a ring rotates within its groove) translates into longer seal life.

The present invention further provides a high pressure seal member wherein the outer lip has a length equal or greater than the length of the inner lip whereby the seal's radially outer surface is equal or greater than its radially inner surface area. In this manner, the seal member is prevented from rotating with the shaft, thereby increasing the life of the seal (and thus the motor).

These and other features of the invention are fully described and particularly pointed out in the claims. The following description and drawings set forth in detail a certain illustrative embodiment of the invention, this embodiment being indicative of but one of the various ways in which the principles of the invention may be employed.

DRAWINGS

DETAILED DESCRIPTION

Figure 1:
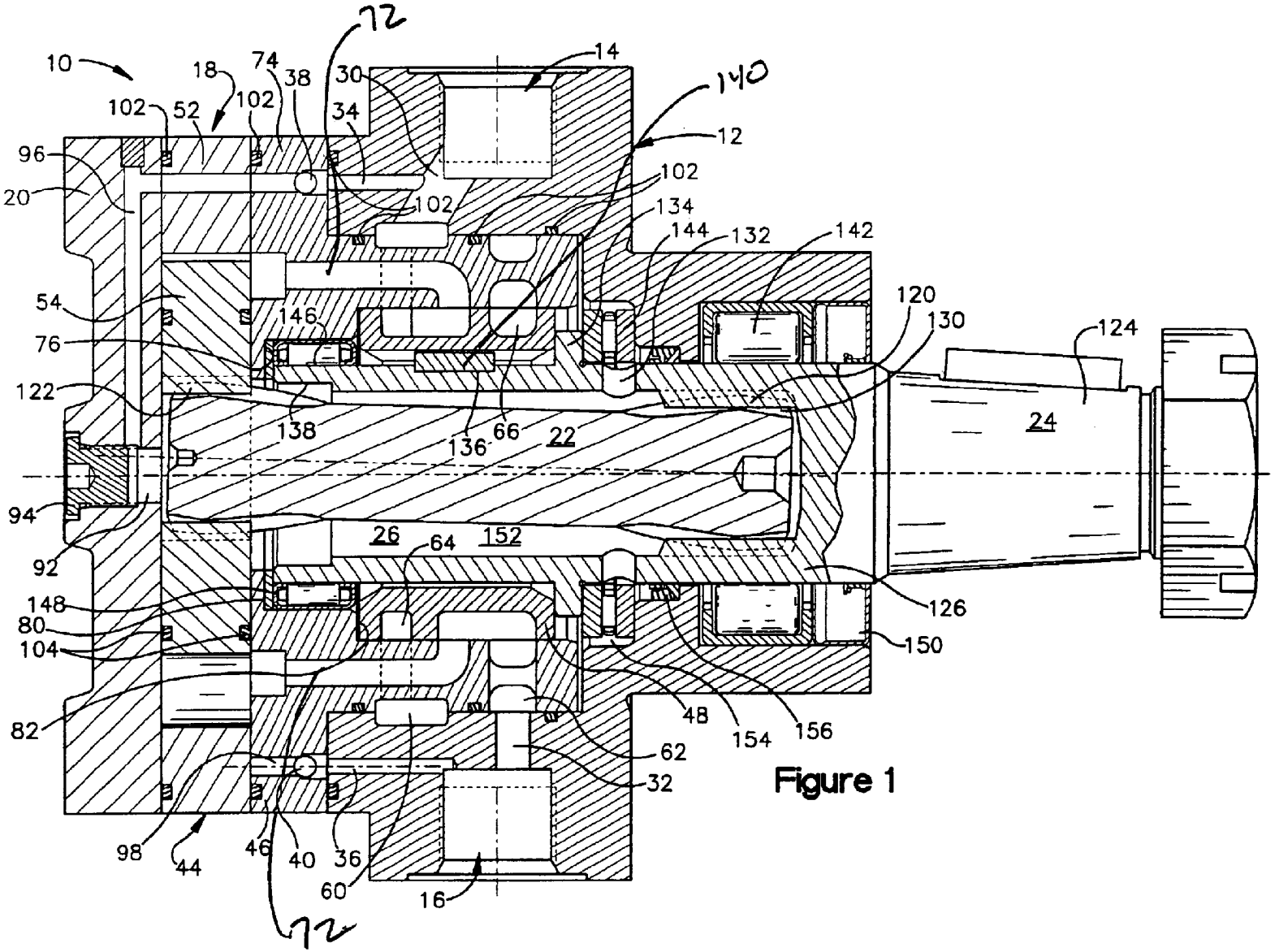
FIG. 1 is a sectional view of a hydraulic motor according to the present invention.
Figure 2A:
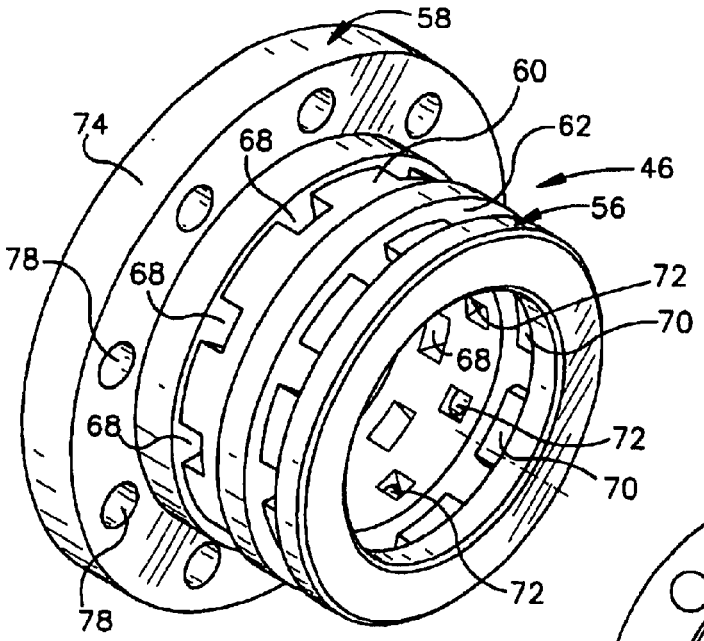
FIGS. 2A–2D are perspective, front, side, and sectional views, respectively, of a stationary manifold isolated from the rest of the motor.
Figure 2B:
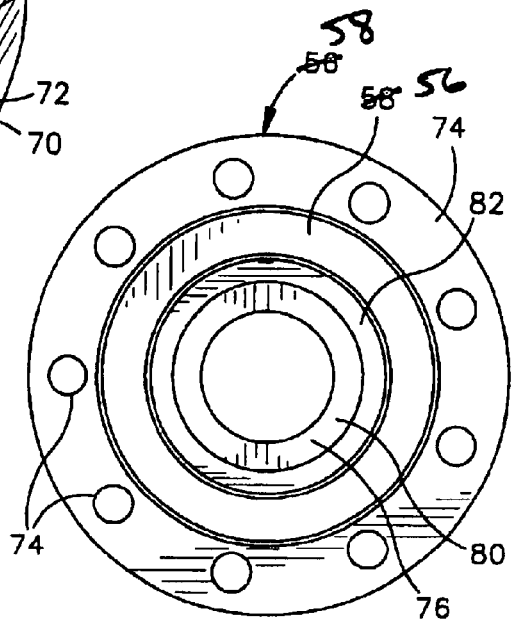
Figure 2C:
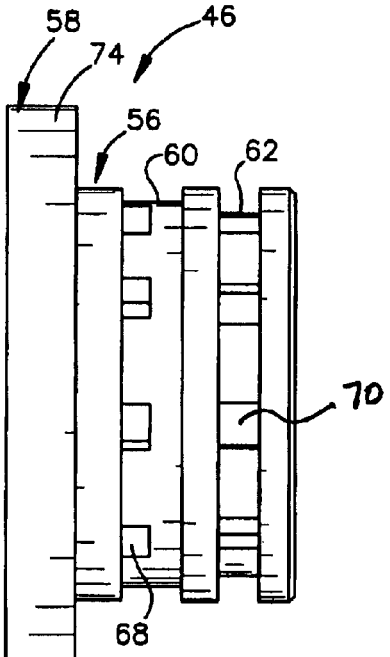
Figure 2D:
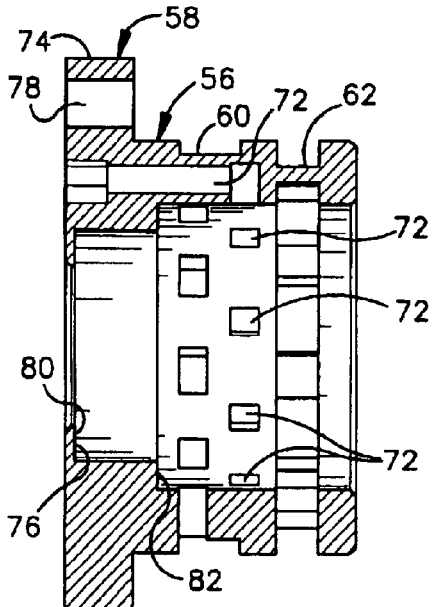

Referring now to the drawings, and initially to FIG. 1, a hydraulic motor 10 according to the present invention is shown. The illustrated hydraulic motor 10 is especially designed for heavy duty applications requiring a short package, a high torque capacity, and generous side load limits. Additionally, the motor 10 can be economically constructed so that it has a relatively low pressure drop, good mechanical/hydraulic performance at low speed and continuous operation, a long service life, and so that it is convertible between a two-pressure-zone mode and a three-pressure-zone mode.

The motor 10 comprises a front housing 12 defining a first port 14 and a second port 16, a drive assembly 18, an end cover 20, a drive link 22 and a shaft 24. As explained in more detail below, the front housing 12, a stationary component of the drive assembly 18 (namely a manifold 46, introduced below), and the end cover 20 together form a central bore 26 in which the drive link 22 and the shaft 24 are rotatably mounted. Although not shown in the illustrated sectional, a plurality of bolts (e.g, nine bolts in a circular array) can extend through registered openings in the front housing 12, the drive assembly 18 and the end cover 20 to clamp these components together.

When the motor 10 is operating in a first direction (e.g., the shaft 24 rotates clockwise), the first port 14 is the inlet port and the second port 16 is the outlet port. When the motor 10 is operating in a second opposite direction (e.g., the shaft 24 rotates counterclockwise), the second port 16 is the inlet port and the first port 14 is the outlet port. In either case, the inlet port can be connected to a pump discharge and the outlet port can be connected to a return line to a reservoir which feeds the pump suction. In response to pressurized fluid passing from the inlet port to the outlet port through a working fluid path, the drive assembly 18 hypocycloidally moves (i.e., orbits and rotates) the drive link 22 and the shaft 24 rotates in a corresponding direction.

The front housing 12 includes a slanted passageway 30 extending between the first port 14 to its radially inner surface and a relatively straight radial passageway 32 extending from the second port 16 to the housing's radially inner surface. As is explained in more detail below, the passageways 30 and 32 form part of the motor's working path.

The front housing 12 also includes passageways 34 and 36 which form part of the motor's non-working path. The passageway 34 extends from the passageway 30 to the rearward axial face of the housing 12 and through a component of the drive assembly 18 (namely a stationary manifold 46, introduced below) whereat it forms a seat for a check valve 38. The passageway 36 extends from the second port 16 to the rearward axial face of the housing 12 and continues through the same component of the drive assembly 18 (i.e., the stationary manifold 46) whereat it forms a seat for a check valve 40.

The drive assembly 18 comprises a gerotor set 44, a stationary manifold 46 and a spool valve 48. The gerotor set 44 comprises a stator 52 and a rotor 54 having different centers with a fixed eccentricity. The stator 52 has internal "teeth" or vanes and the rotor 54 has one less external "tooth" or lobe and these lobes/vanes form fluid pockets. Fluid is supplied and exhausted from these pockets by passages in the manifold 46 (namely passages 72, introduced below) which are systematically opened and closed by the spool valve 48 as it is moved with the shaft 24. As fluid is supplied and exhausted from the fluid pockets in a timed relationship, the rotor 54 moves hypocycloidally (i.e., orbits and rotates) relative to the stator 52.

The illustrated gerotor set 44 is a 8×9 gerotor set, that is, the stator 52 has nine vanes and the rotor 54 has eight lobes, and these components cooperate to form nine fluid pockets. When compared to, for example, a 6×7 gerotor set, the 8×9 gerotor set 44 allows a larger drive link to be assembled inside the rotor 54, thereby providing a higher torque capacity. Also, the 8×9 gerotor set 44 allows a lower eccentricity (e.g., 3 mm) for a desired displacement capacity, thereby providing smoother rotation of the rotor 54 and better spline engagement between the drive link 22 and the rotor 54. That being said, other gerotor designs (e.g., a 6×7 gerotor set) are possible with, and contemplated by, the present invention.

The stationary manifold 46, which is shown isolated from the rest of the motor 10 in FIGS. 2A–2D, includes a front portion 56 and a rear portion 58. The front portion 56 is located within the housing 12. The radially outer surface of the front portion (together with the housing 12) defines a first outer annular groove 60 and a second outer annular groove 62. The first groove 60 communicates with the first port 14, via the passageway 30, and the second annular groove 62 communicates with the second port 16, via the passageway 32.

Figure 3A:
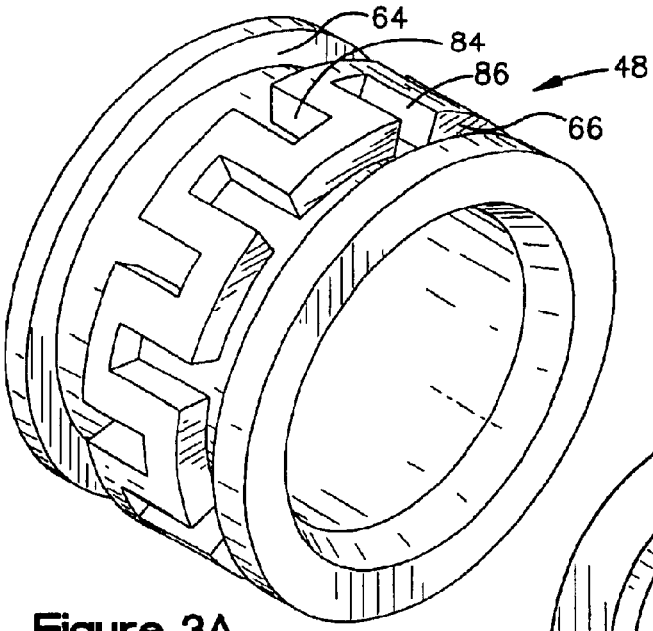
FIGS. 3A–3D are perspective, front, side, and sectional views, respectively, of a spool valve isolated from the rest of the motor.
Figure 3B:
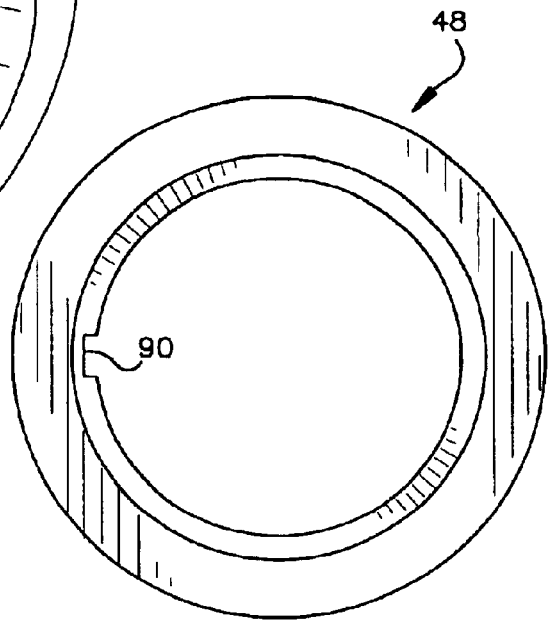
Figure 3C:
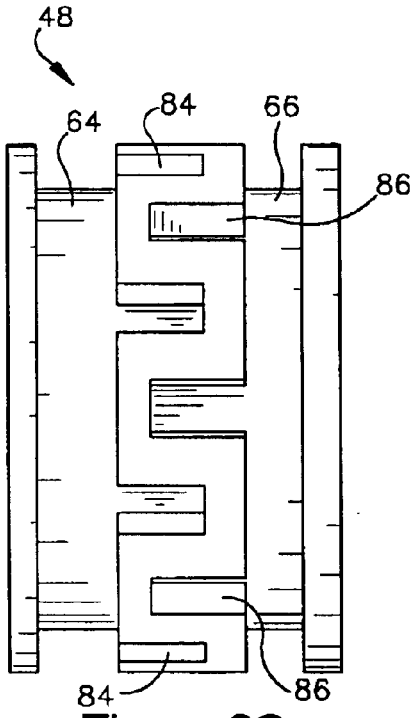
Figure 3D:
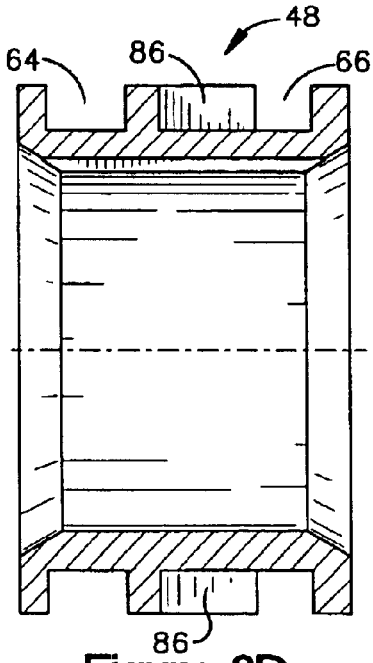

The radially inward surface of the manifold front portion 56 is positioned flush against the radially outer surface of the spool valve 48. These flush interfacing surfaces together define a first inner annular groove 64 and a second inner annular groove 66 (see FIG. 1, also see FIGS. 3A, 3C and 3D). The grooves 64 and 66 are axially aligned, respectively, with the first and second outer grooves 60 and 62. A first set of radial throughways 68 connect the outer groove 60 with the inner groove 64 and a second set of radial throughways 70 connect the outer groove 62 with the inner groove 66. Thus, the first inner groove 64 communicates with the first port 14 and the second inner groove 66 communicates with the second port 16 regardless of the rotational position of the spool valve 48.

The manifold 46 also includes rotor-interfacing passages 72 which are staggered and radially arranged so that they do not intersect with the radial throughways 68 and 70. Each passage 72 extends between the radial inner surface of the manifold front portion 56 and through the rear portion 58 to the rear axial end face of the manifold 46.

The rear portion 58 includes a radially outer flange 74 and a radially inner flange 76. The outer flange 74 includes openings 78 for the clamping bolts (FIGS. 2A and 2B) and the passageways 34 and 36 (and the check valves 38 and 40) are located within the flange 74 (FIG. 1). The inner flange 76 has a stepped profile forming a rear ledge 80 and a front ledge 82. The ledge 80 forms a compartment for certain shaft-related components (namely a radial needle bearing 146 and a thrust bearing 148, introduced below). The ledge 82 forms a front stop for the spool valve 48.

It may be noted that in the illustrated embodiment the housing 12 and the manifold 46 are separately formed components which are joined together. Such a two-piece construction is often preferred because it provides ease in manufacture and assembly. However, the integration of the manifold 46 into the housing 12 (and/or the integration of any other stationary component of the drive assembly 18, such as the stator 52) is possible with, and contemplated by, the present invention.

As is best seen by referring additionally to FIGS. 3A–3D, the radially outer surface of the spool valve 48 includes a first set of slots 84 extending frontward from the first annular groove 64, and a second set of slots 86 extending rearward from the second annular groove 66. (FIGS. 1, 3A, 3C and 3D.) The slots 84/86 connect/disconnect the rotor-interfacing manifold passages 72 as the spool valve 48 rotates relative to the stationary manifold 46. In this manner, fluid is supplied and exhausted to the gerotor set 44.

The radially inner surface of the spool valve 48 includes a key notch 90. (See FIG. 3.) As is explained in more detail below, this key notch 90 is part of the coupling arrangement between the spool valve 48 and the shaft 24.

The end cover 20, in the illustrated embodiment, functions as a rear lid for the motor 10. The cover 20 has a disk-like shape with one axial end face comprising the rear wall of the motor 10 and another axial end face positioned flush against the gerotor set 44. A central passage 92 extends axially through the end cover 20 and is sealed by a case drain plug 94. A first L-shaped passage 96 extends radially outward from the passage 92 and then axially inward through the stator 52 and the manifold 46 to the check valve 38. Another similar passage 98 (partially hidden in the illustrated sectional) extends from the passage 92 to the check valve 40. As is explained in more detail below, the case drain plug 94 allows a conversion between a two-pressure-zone mode and a three-pressure-zone mode.

As was indicated above, a plurality of bolts (not shown in the illustrated sectional) can be used to clamp together the front housing 12, the stationary components of the drive assembly 18 (i.e., the stator 52 and the manifold 46), and the end cover 20. Conventional sealing rings 102 can be provided (in appropriate grooves) to prevent leakage between these components. Sealing rings 104 are also provided between the end cover 20 and the rotor 54 and between the stationary manifold 46 and the rotor 54. The rings 102 can be made of nitrile rubber and the rings 104 can be made of a polyimide resin, such as VESPEL® (a trademark of DuPont for a temperature-resistant thermosetting polyimide resin).

Figure 4A:
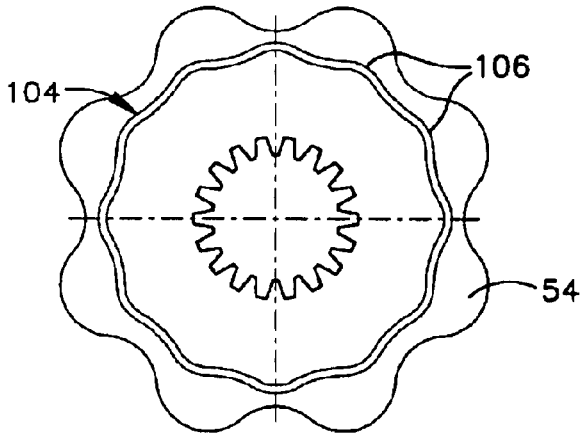
FIGS. 4A–4C are front schematic views of seal/groove arrangements according to the present invention.
Figure 4B:
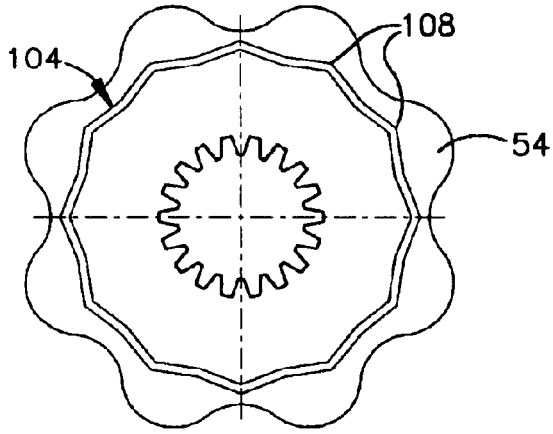
Figure 4C:
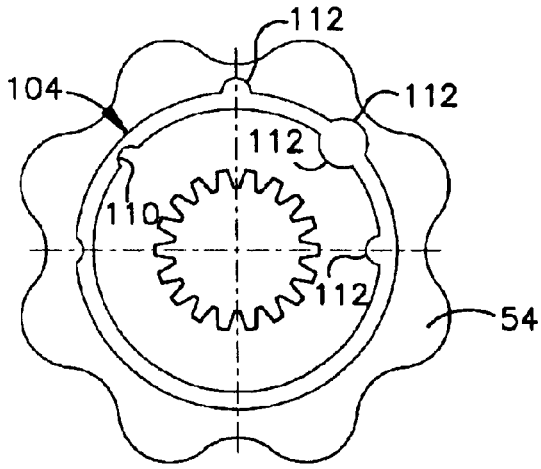

With particular reference to the sealing rings 104, they are positioned within appropriately sized/shaped grooves in the rotor 54 whereby they rotate/orbit with the rotor 54 during operation of the motor 10. As is best seen by referring additionally to FIGS. 4A–4C, these rotor interface seals are designed to prevent the rings 104 from shifting within the groove during movement of the rotor 54. Specifically, the seals/grooves are given a rotationally incompatible geometry. For example, a series of curved undulations 106 could be used to trace a substantially circular shape such as shown in FIG. 4A. If the sealing ring 104 was inclined to shift clockwise (or counterclockwise) relative to the groove, the undulations 106 would serve as stops to prevent this rotation. The seal/groove could instead have a many-sided (e.g. twelve) polygonal shape with a series of corners 108 serving as rotation-preventing stops as is shown in FIG. 4B. Alternatively, the seal/groove geometry could have a standard ring-shape with the rotation-preventing stops being notches 110 and/or tabs 112 formed on its inner and/or outer diameters as is shown in FIG. 4C.

The elimination of ring-rotation helps to reduce interface friction between the rotor 54 and the stationary components (e.g., the end cover 20 and the manifold 46). This friction reduction can be especially significant during motor start-up as well as during continuous low speed operation of the motor 10, and can provide improved mechanical and hydraulic performance. Also, the minimization of interface friction in combination with the essential elimination of groove-to-seal friction (which results when a ring rotates within its groove) translates into longer seal life. Further, during start-up or very slow speed operation (e.g., 10 rpm or less), the ring tends to stay seated in the groove, thereby eliminating mechanical friction.

The drive link 22 has a roughly cylindrical shape instead of a more "dog-bone" shape, as is often used in high torque motors. The drive link 22 has front external splines 120 which mate with internal splines on the shaft 24 and rear external splines 122 which mate with internal splines on the rotor 54. The use of the spool valve 48 (instead of, for example, an orbital commutator) allows the rear external splines 122 to be designed symmetrically. This provides a "minimized wobble" drive link style which allows a motor construction having a shorter package, a larger shaft, a higher torque capacity, and a longer service life.

The shaft 24 has a front portion 124 which projects outwardly from the housing 12 (for coupling to the shaft of the desired piece of machinery) and a sleeve portion 126. The sleeve portion 126, which surrounds a majority of the length of the drive link 22, has (from front to rear) internal splines 130, radial passageways 132, an external flange 134, a key notch 136, and an internal ledge 138. The internal splines 130 mate with the external splines 122 on the drive link 22. The radial passageways 132 connect chambers (namely chambers 152 and 154, introduced below) in the non-working path of the motor 10. The external flange 134 serves as front stop for the spool valve 48, and also forms a compartment for a bearing member (namely a thrust bearing 144, introduced below). The ledge 138 accommodates the increased diameter of the rear external splines 122 on the drive link 22.

Figure 5A:
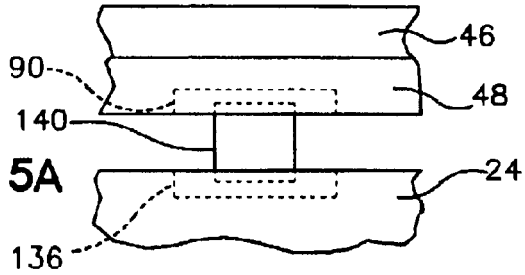
FIG. 5A is a close-up schematic view of the manifold-spool-shaft positioning arrangement according to the present invention.

As is shown in FIG. 1, and as is schematically shown in FIG. 5A, a key 140 is used to transfer rotational motion from the shaft 24 to the spool valve 48. The key 140 rides in the notch 90 in the spool valve 48 and in the notch 136 in the shaft 24. The notches 90 and 136 are sized to retain the key 140 therebetween but at the same time to allow the key 140 to float relative to the shaft 24 and the spool valve 146. As is best seen by comparing FIGS. 5B and 5C, the floating shaft-to-spool coupling arrangement of the present invention allows the transfer of rotational motion from the shaft 24 to the spool valve 48 without transferring any side loads onto the shaft 24. Specifically, the floatation of the key 140 within the notches 90 and 136 compensates for any deflection of the shaft 24.

Figure 5B:
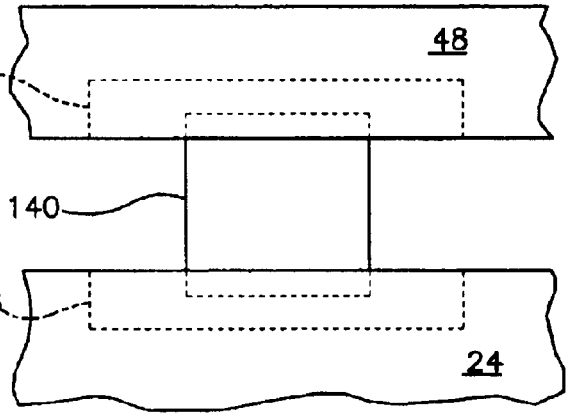
FIG. 5B is an even closer-up schematic view showing the keyed connection between the spool and the shaft when the shaft is in a non-deflected condition.
Figure 5C:
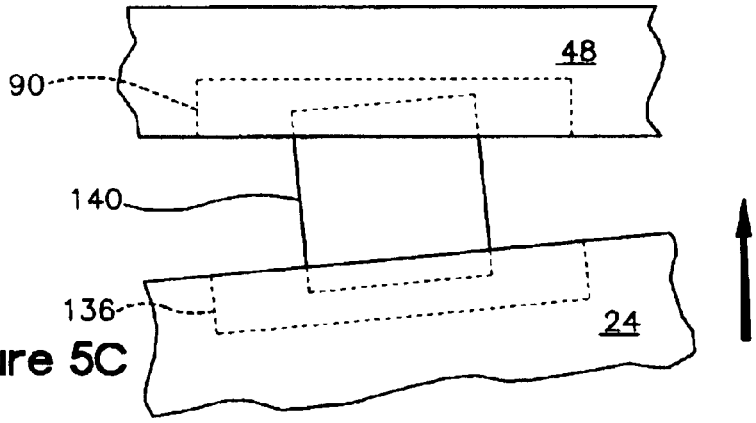
FIG. 5C is a schematic view similar to FIG. 5B except that the shaft is in a deflected condition.

It may be noted that the notch size, key size and clearance size are somewhat exaggerated in schematic FIGS. 5A–5C for the purposes of explanation. In actual motor designs, the radial clearance between the shaft 24 and the spool valve 48 should be large enough to compensate for possible eccentricity therebetween while still ensuring an effective contact area for the key 140 for the transfer of rotational movement. Clearances in the range of 0.010 inch are believed to be acceptable for many motor constructions.

Thus, with the present invention, side loads on the shaft 24 are not transferred to the spool valve 48 but can instead be absorbed by the motor's bearing system (in the illustrated embodiment, radial bearings 142 and 146 introduced below). Accordingly, the motor 10 can take on large side loads and/or high radial torque while still positioning the spool valve 48 in the front housing 12. This translates into a shorter package size and less working pressure drop.

In the illustrated embodiment, the shaft-to-spool coupling arrangement is accomplished with a separate key 140 being engaged in notches in both the shaft 26 and the spool valve 48. However, the key could instead be connected to the shaft 26 and/or the spool valve 46. Moreover, non-keyed coupling arrangements, which allow the appropriate deflection-shielding movement of a coupling element relative to the shaft 24 and the spool valve 48, are possible with and contemplated by the present invention.

Bearings are positioned around the shaft 24 within the central bore 26 to accommodate radial and axial loads. In the illustrated embodiment, these bearings include a heavy duty radial bearing 142 in a front compartment of the housing 12, a light duty thrust bearing 144 in the compartment formed by the shaft flange 134 and the front housing 12, and a radial needle bearing 146 in the compartment formed by ledge 80 of the manifold 46. The use of the front heavy duty radial bearing 142 allows the motor 10 to handle a high side load while the overall bearing arrangement results in a low cost construction and a long service life. A thrust bearing 148 can also be positioned at the rear end of the manifold ledge 80 and/or a dirt seal 150 can be provided at the exposed axial end face of the housing 12.

A fluid chamber 152 surrounds the drive link 22 as it extends through the rotor 54, the manifold 46, and into the sleeve portion 126 of the shaft 24. (It may be noted for future reference that the fluid chamber 152 is in communication with the central passage 92 in the end cover 20.) Another fluid chamber 154 surrounds the shaft 24 and this chamber 154 includes the shaft-spool clearance and spaces surrounding the bearings 144 and 146. A high pressure seal assembly 156 is used seal the front end of fluid chamber 154.

Figure 6:
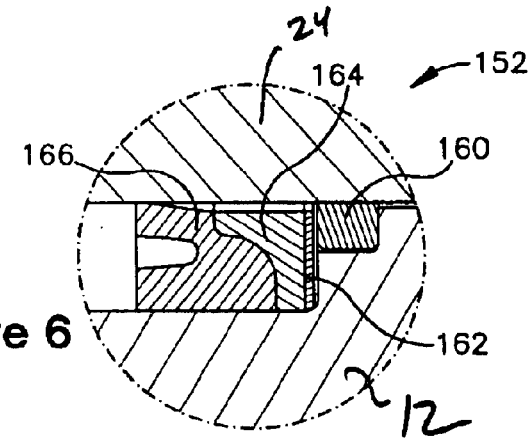
FIG. 6 is a close-up sectional view of a high pressure sealing assembly according to the present invention.

As is best seen by referring to FIG. 6, the high pressure seal assembly 156 includes a floating ring 160, a back-up washer 162, and a composite seal made from members 164 and 166. The inner diameter of the floating ring 160 is piloted on the shaft 24 with a very tight clearance. The outer diameter of the washer 162 is piloted on the housing 12 with a tight clearance. The seal member 164 has a cross-sectional shape roughly resembling a square with a semi-circular bite taken out of its rear outer corner. The seal member 166 has a cross-sectional shape with a front profile for fitting into the seal member 164 in a puzzle-like manner, and a rear profile having an axial U-slot. The radially outer surfaces of the seal members 164 and 166 are piloted on the housing bore with a very tight clearance.

Significantly, the radially outer surface area of the seal member 166 (e.g., the area in contact with the housing 12) is equal or greater than its radially inner surface area (i.e., the area adjacent the shaft 24). In the illustrated embodiment, this is accomplished by the outer lip having a greater or equal length than the inner lip of the seal member 166. In this manner, the member 164 and/or member 166 will be encouraged to remain stationary with the housing 12, rather than rotating with the shaft 24, thereby increasing the life of the seal.

Figure 7A:
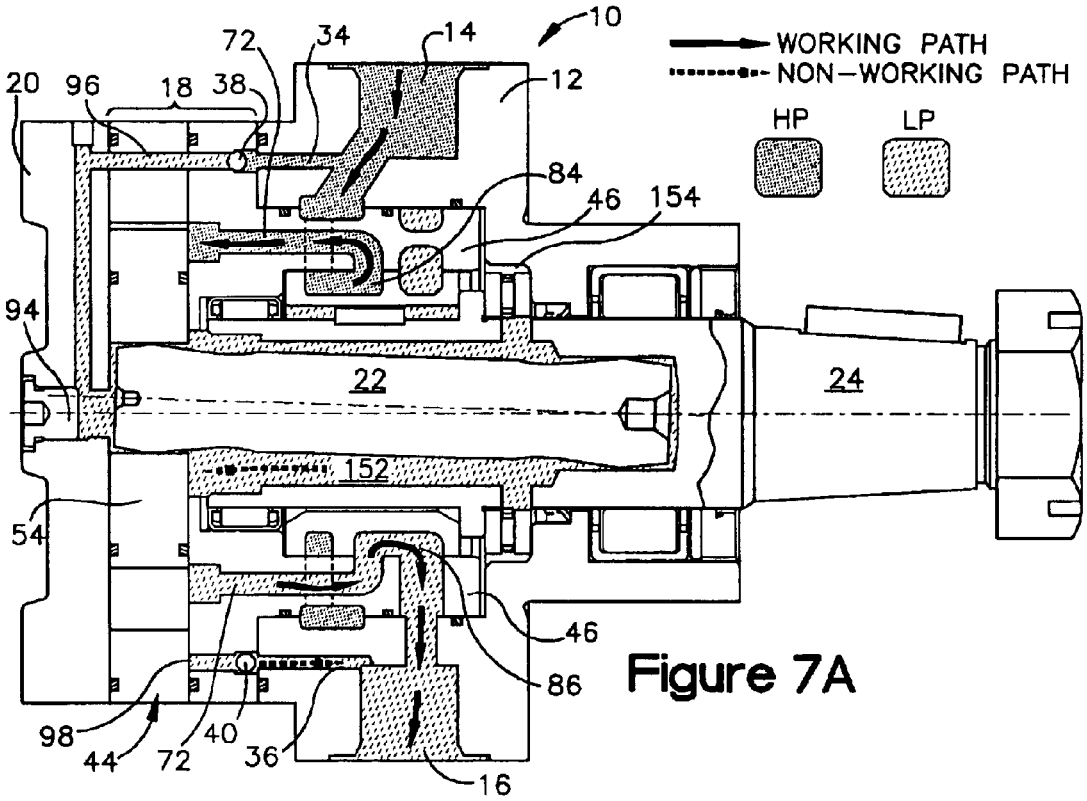
FIGS. 7A and 7B are schematic illustrations of the motor being run a first direction and a second direction, respectively, in a two pressure zone mode.
Figure 7B:
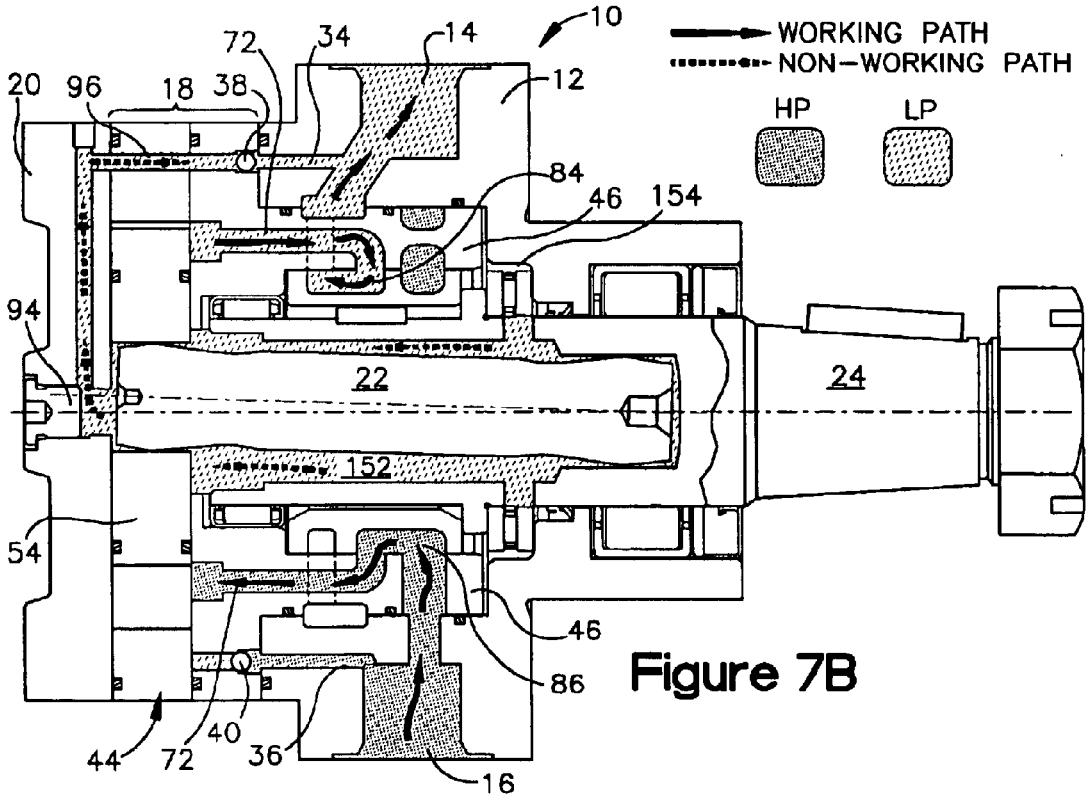

Referring now to FIGS. 7A and 7B, the flow circuit of the motor 10 is schematically shown when the motor is operating in a two-pressure mode in the first and second directions, respectively. In these schematic illustrations, high pressure regions (pre-working) are represented by dark shading and low pressure regions (post-working) are represented by light shading. Also, the working path of the fluid (e.g., the path that fluid follows to cause rotation of the shaft 24) is represented by solid arrows and the non-working path of the fluid (e.g., the path that fluid follows for cooling, lubrication and/or sealing) is represented by dashed arrows.

When the motor 10 is operating in the first direction shown in FIG. 7A, high pressure fluid is introduced through the first port 14 and travels through the manifold passageways 72 when they are connected with the spool slots 84. The manifold 46 thereby channels the high pressure fluid to the fluid pockets of the gerotor set 44 and the rotor 54 orbits/rotates in a first direction (e.g, clockwise). The now-low-pressure (post-working) fluid then flows back through the manifold passageways 72 when they are connected with the spool slots 86 and exits the motor 20 through the second port 16. (See solid arrows in FIG. 7A.).

When the motor 10 is operating in the second direction shown in FIG. 7B, high pressure fluid is introduced through the second port 16 and travels through the manifold passageways 72 when they are connected with the spool slots 86. The manifold 46 thereby channels the high pressure fluid to the fluid pockets of the gerotor set 44 and the rotor 54 orbits/rotates in a second direction (e.g, counter-clockwise). The now-low-pressure (post-working) fluid then flows back through the manifold passageways 72 when they are connected with the spool slots 84 and exits the motor 10 through the first port 14. (See solid arrows in FIG. 7A.).

When the motor 10 is operating in either the first direction or the second direction, a relatively small portion of the high pressure fluid bypasses the working path and flows into the chambers 152 and 154. This bypass of the working path occurs at certain expected leakage zones, such as at the side clearances at the axial faces of the rotor 54 (in the range of about 0.001 inch) and/or at the radial clearance between the manifold 46 and the spool valve 48 (in the range of about 0.0005 inch). Thus, although the fluid in the non-working path is schematically shown at the same pressure as the high pressure fluid, there will be a pressure drop as it passes through these leakage clearances, but not as great of a pressure drop as occurs in the working path.

If the motor is operating in the first direction, the fluid then flows through the passageway 98, opens the check valve 40, and travels through the passageway 36 to the second port 16, whereat it mixes with the exiting fluid of the working path. (See dashed arrows in FIG. 7A.) If the motor is operating in the second direction, the fluid then flows through the passageway 96, opens the check valve 38, and travels through the passageway 34 to the first port 14, whereat it mixes with the exiting working path fluid. (See dashed arrows in FIG. 7B.).

Figure 8A:
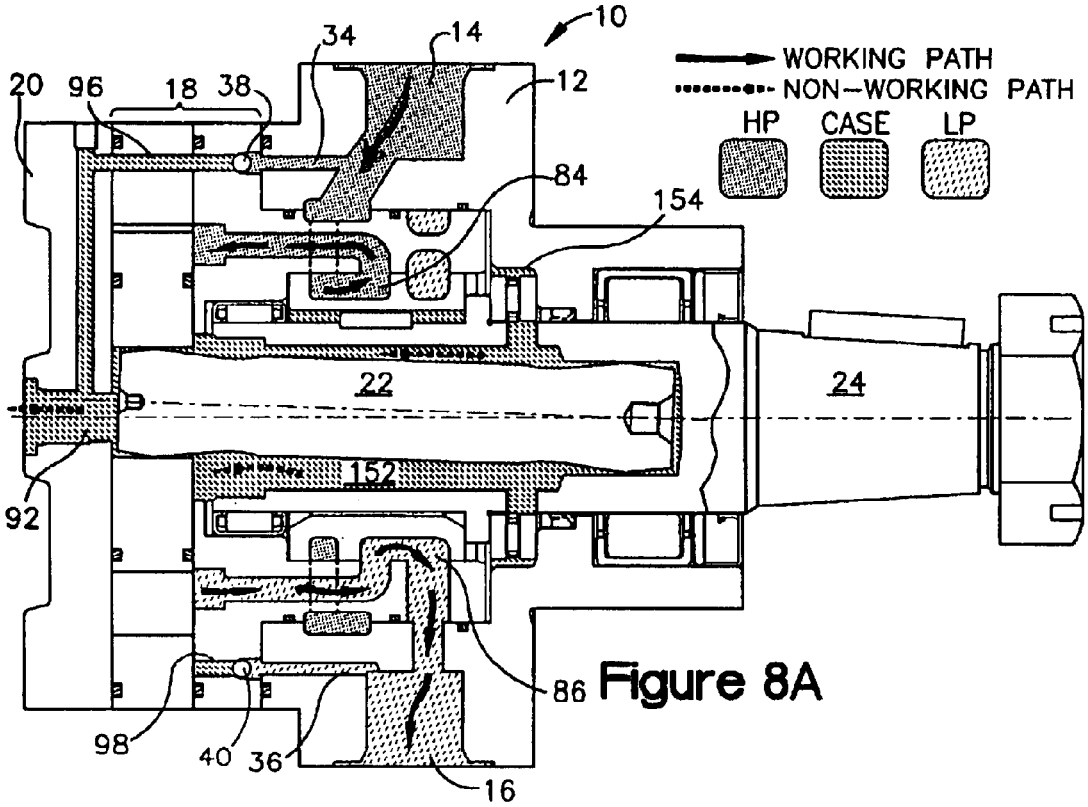
FIGS. 8A and 8B are schematic illustrations of the motor being run in a first direction and a second direction, respectively, in a three pressure zone mode.
Figure 8B:
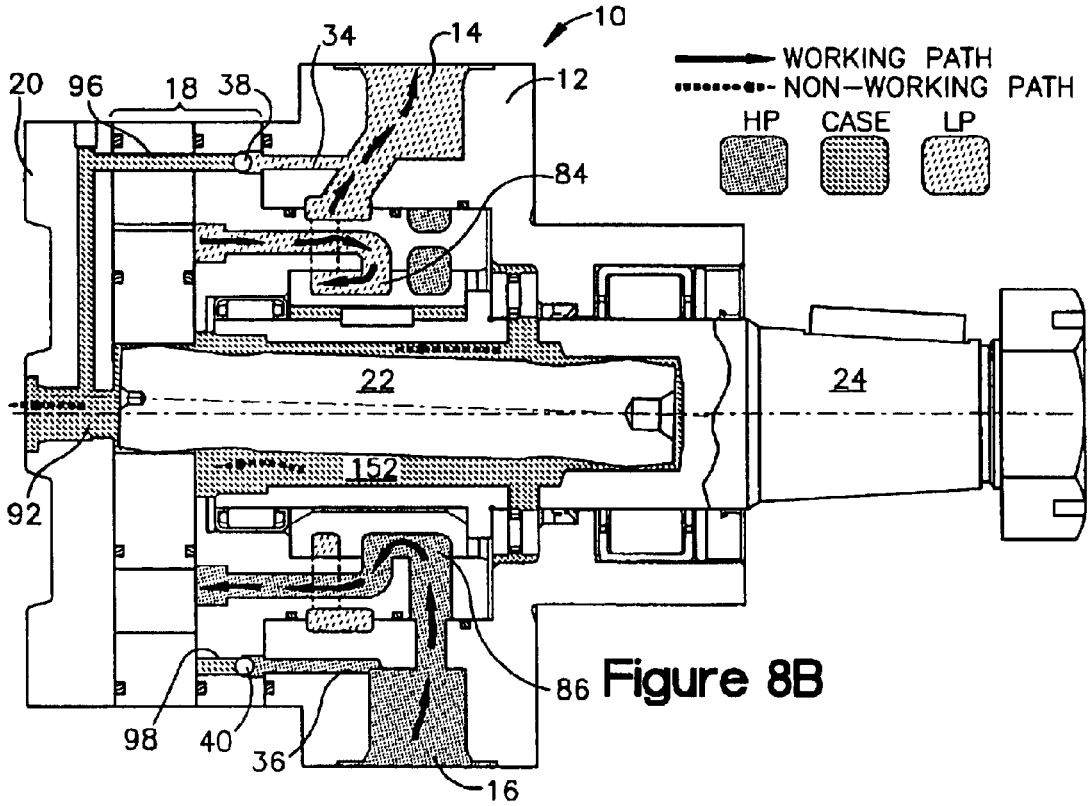

Referring now to FIGS. 8A and 8B, the flow circuit of the motor 10 is schematically shown when the motor 10 is operating in a three-pressure-zone mode in first and second directions, respectively. In this mode of operation, the case drain plug 94 is removed and the central passage 92 is connected to a reservoir (not shown). The high pressure regions, the low pressure regions, and the case drain pressure regions are represented by different shading. Also, the working path is represented by solid arrows and the non-working path is represented by dashed arrows.

The working path for the motor 10 in the three-pressure-zone mode is essentially the same as the working path for the motor 10 in the two-pressure-zone mode. (See solid arrows in FIGS. 8A and 8B.) However, the non-working path for the motor 10 in this mode differs in that the fluid from the chambers 152 and 154 exits the motor 10 through the passage 92 instead of mixing with the exiting fluid. (See dashed arrows in FIGS. 8A and 8B.) It may be noted that the case pressure is less than both the high pressure and the low pressure, whereby the check valves 38 and 40 prevent fluid from the non-working path from rejoining with the fluid in the working path.

One may now appreciate that the present invention provides a hydraulic motor 10 that is especially suited for heavy duty applications requiring a short package, a high torque capacity, and generous side load limits. Additionally, the motor 10 can be economically constructed so that it has a relatively low pressure drop, good mechanical/hydraulic performance at low speed and continuous operation, a long service life, and is convertible between a two-pressure-zone mode and a three-pressure-zone mode.

Although the invention has been shown and described with respect to a certain preferred embodiment, it is obvious that equivalent and obvious alterations and modifications will occur to others skilled in the art upon the reading and understanding of this specification.

What is claimed is:

1. A hydraulic motor comprising a front housing having a first port and a second port, a manifold, a spool valve, a drive link, and a shaft;

wherein the front housing and the manifold form a central bore in which the spool valve, the drive link and the shaft are rotatably mounted;

wherein the front housing, the manifold, and the spool valve define a working path between the first port and the second port so that, when pressurized fluid travels through the working path, the drive link is hypocycloidally moved;

wherein the drive link is coupled to the shaft so that rotational motion is transferred thereto and the shaft is coupled to the spool valve so that rotational motion is transferred thereto; and wherein the coupling between the spool valve and the shaft includes a separate coupling element which floats relative to the shaft and the spool valve.

2. A hydraulic motor as set forth in claim 1, further comprising at least one radial bearing which absorbs side loads on the shaft.

3. A hydraulic motor as set forth in claim 1, further comprising an end cover.

4. A hydraulic motor as set forth in claim 1, wherein the shaft includes a notch on an radially outer surface, wherein the spool valve includes a notch on an inner radial surface, and wherein the coupling element is a separate key that floats within said notches.

5. A hydraulic motor as set forth in claim 1, wherein the flow circuit also comprises a non-working path passing through chambers surrounding the drive link and the shaft.

6. A hydraulic motor as set forth in claim 5, wherein the motor is convertible between:

a two-pressure-zone mode wherein the non-working path joins the working path at its exit; and a three-pressure-zone mode wherein the non-working path exits through a case drain.

7. A hydraulic motor as set forth in claim 1, further comprising a rotor movably positioned adjacent to an axial face of the manifold and a sealing ring positioned in a groove to seal the interface between the rotor and the manifold, and wherein the sealing ring and the groove have a rotationally incompatible geometry.

8. A hydraulic motor as set forth in claim 7, wherein the geometry includes curved undulations, comers, notches and/or tabs which serve as rotation-preventing stops.

9. A hydraulic motor as set forth in claim 7, wherein the rotor contains the groove.

10. A hydraulic motor as set forth claim 1, further comprising a high pressure seal assembly which is positioned between the housing and the shaft and which seals a front end of a chamber surrounding the shaft, and wherein the high pressure seal assembly includes a first seal member having a radially outer surface area equal or greater than its radially inner surface area, whereby the first seal member is discouraged from rotating with the shaft.

11. A hydraulic motor as set forth in claim 10, wherein the high pressure seal assembly includes a floating ring piloted on the shaft.

12. A hydraulic motor as set forth in claim 10, wherein the high pressure seal assembly includes a back-up washer piloted on the housing.

13. A hydraulic motor as set forth in claim 10, wherein the high pressure seal assembly comprises a second seal member which is joined with the first seal member in a puzzle-like manner and which is also piloted on the housing bore with a very tight clearance.

14. A hydraulic motor as set forth in claim 10, wherein the first seal member has an inner lip and an outer lip and wherein the outer lip is equal to or longer than the inner lip.

* * * * *